US007059351B1

(12) United States Patent
Chu et al.

(10) Patent No.: US 7,059,351 B1
(45) Date of Patent: Jun. 13, 2006

(54) SURFACE-TENSION-GUIDED LIQUID TRANSPORTATION DEVICE

(75) Inventors: Chin-Chou Chu, Taipei (TW); Chien-Fu Chen, Kaohsiung (TW); Chun-Fei Kung, Tucheng (TW); Chien-Cheng Chang, Taipei (TW); Fan-Gang Tseng, Hsinchu (TW)

(73) Assignee: National Taiwan University, Taipei (TW)

( * ) Notice: Subject to any disclaimer, the term of this patent is extended or adjusted under 35 U.S.C. 154(b) by 0 days.

(21) Appl. No.: 11/293,137

(22) Filed: Dec. 5, 2005

(51) Int. Cl.
*F15C 1/04* (2006.01)
*F15C 1/06* (2006.01)

(52) U.S. Cl. ..... 137/825; 137/806; 137/807; 137/814; 137/833; 251/368

(58) Field of Classification Search ..... 137/825, 137/806, 807, 814, 833; 251/368
See application file for complete search history.

(56) References Cited

U.S. PATENT DOCUMENTS

| | | | | |
|---|---|---|---|---|
| 5,640,995 | A * | 6/1997 | Packard et al. | 137/597 |
| 5,842,787 | A * | 12/1998 | Kopf-Sill et al. | 366/340 |
| 5,964,239 | A * | 10/1999 | Loux et al. | 137/15.21 |
| 6,136,212 | A * | 10/2000 | Mastrangelo et al. | 216/49 |
| 6,443,179 | B1 * | 9/2002 | Benavides et al. | 137/454.2 |
| 6,899,137 | B1 * | 5/2005 | Unger et al. | 137/833 |
| 7,004,198 | B1 * | 2/2006 | Okandan et al. | 137/827 |
| 2005/0166980 | A1 * | 8/2005 | Unger et al. | 137/833 |

* cited by examiner

*Primary Examiner*—A. Michael Chambers
(74) *Attorney, Agent, or Firm*—Rosenberg, Klein & Lee

(57) ABSTRACT

A liquid transportation device includes a working board, a working liquid, a liquid channel and a cover board, wherein the liquid channel is formed on a top surface of the working board, the covering board is fully covered the liquid channel, the liquid channel composed of a material substantially tending to the liquid, and the covering board is composed of a material substantially phobic to the liquid. The working liquid flows within the liquid channel in guidance of the deviation of surface tension between the liquid channel to the working liquid, and the covering board to the working liquid, so that the working liquid is transported within the liquid channel without any external power.

11 Claims, 8 Drawing Sheets

SURFACE-TENSION-GUIDED LIQUID TRANSPORTATION DEVICE

FIELD OF THE INVENTION

The present invention relates to a liquid transportation device, and more particularly to a liquid transportation device wherein a working liquid is transported within a liquid channel and guided by surface tension without any external power thereof.

BACKGROUND OF THE INVENTION

Looking forward the progressive development of the electrical and information related device, light, thinness, short and small have almost been the common consensus of the public, so as to that the Micro Electro-Mechanical Systems (MEMS) are widely used in many kinds of novel electric and information related devices. In the Micro Electro-Mechanical Systems, all related science theorem and technique, such as material, optics, mechanism, electric, electronics, system control, chemical engineering, dynamics, etc., most of the micro constructions or elements are produced by semi-conduct production techniques, and further fitted and connected with each other to produce different systematized products. Meanwhile, in a wide viewpoint, the technical application also widely expands to the fields of national defense industry, biological and medical test, consumer electrical product, and aviation technique, etc.

Besides, due to the minimization of the systems, the troubles about traditional design limited by working platform dimension and sampling scales, etc. can be overcome and progressively improved to lead the current technical development and absorb more and more skilled people participating in this research field.

Moreover, micro fluid has already played an important role in Micro Electro-Mechanical Systems, so that the relative applications are also innumerable, such as light portable biological and medical test equipment, medicine test equipment, chemical analysis test device, medicine efficiency estimation, etc., also almost can not depart from the application field of micro fluid.

From above description, we can further realize that the flowing, mixing and sampling are the most important procedures in the micro fluid application, especially for the mixing rate. Accordingly, we can quote Fick's Law and the characteristics of material being phobic or tending to liquid, and provide further statement for the invention.

According to Fick's Law, different liquids are mixed from the diffusion action of molecules, and the larger surface area the different liquids touch with each other, the higher mixing rate is generated.

In addition, a material tending to a liquid means a contact angle between the material and the liquid is less than 90 degree, and a material phobic to a liquid means a contact angle between the material and the liquid is greater than 90 degree.

Under the base of Fick's Law and the material characteristics, let us go back to current application. In general, different liquids are usually mixed through the methods of generating three-dimensional fluid field and turbulent by stirring. However, in a micro liquid flowing system, liquids are usually not able to mixes effectively due to the limitation of the micro working platform dimension and large viscous coefficient.

As we all know, there are many methods, such as producing pressure gradient, thermal deviation, electrostatic, continuous electro-wetting effect (CEW) or magnetic fields, etc., used for driving fluids, especially for liquids, flowing within micro pipes or channels. While, it is still necessary to use the methods of producing vapor pressure deviation by heating, generating energy deviation by setting electric poles based on microelement production techniques, and generating voltage deviation by electrolyte electrolysis. Thus, it is not only necessary to install additional peripheral components, but also difficult to control the flowing situation of the liquids.

SUMMARY OF THE INVENTION

In the current micro electromechanical devices and chemical-biological test equipments, both the flowing and mixing of liquids have already played important roles. Especially for the liquids within micro pipes or channels, they are usually limited by the micro flowing dimension and large liquid viscous force and cannot be driven easily. Though that they can be driven, they still need take advantages via external force. Among all the methods needed external driving forces, the methods of producing pressure gradient, thermal deviation, electrostatic, continuous electro-wetting effect (CEW) or magnetic fields, etc., are usually be used by operation people.

However, additional power output devices are usually necessary to be installed in these methods, so that the whole capacity and layout space will always be increased. Moreover, in the aspects of biology specimens sampling, testing and analyzing, the said additional power or external forces are very probable to distort the specimens and influence the test operator in getting correct analysis results.

According to the disadvantages as above descriptions, the a primary object of the present invention is providing a liquid transportation device operated by a natural phenomenon of surface-tension, so that the liquids can flow within channels within the device without any external force. Through the use of the device, the installation and construction of micro electromechanical or chemical-biological device can be progressively simplified.

A secondary object of the present invention is providing a surface-tension guided liquid transportation device, wherein the channels within the surface-tension guided liquid transportation device can be adjusted in accordance with different flowing parameters, such as total flowing time, flowing rate and flowing distance, etc., and the mixing requirements between "liquid to liquid" and "liquid to solid", such as mixing time, molecule diffusion time, mixing rate, etc. Through the use of the device, the object of flowing and mixing can be achieved under the condition that the original chemical or biological specimens are not distorted.

To solve above problems, a method in accordance with the invention is providing a surface-tension guided liquid transportation device comprising a working board, at least one liquid channel, at least one covering board for transporting at least one working liquid. Through the material selection of the working board, the liquid channel and the covering board in accordance with the property of tending or phobic to the working liquid, a deviation of surface tension can be generated to provide a power for guiding the working liquid flowing in a specified direction.

Besides, in order to make a further control to liquid flowing situation and the mixing efficiency between the liquid to another reactant presented in liquid or solid, some additional proper adjustment mechanisms, such as liquid control runners, liquid control gates and throttling wedges are arranged in accordance with the specified embodiments of the invention, so that the flowing rate, the flowing time and the flowing speed of liquids can be adjusted, and the mixing time and mixing rate between "liquid to liquid" and "liquid to solid" can be progressively controlled.

Compare with the conventional liquid driving device, the liquid transportation device in accordance with the present invention not only can drive the liquids flowing without external force, but also can simplifying the installation and construction of micro electromechanical or chemical-biological device, progressively control flowing parameter and mixing situations, and keep the chemical or biological specimens in original state for testing and analyzing. Accordingly, the present invent not only solves the conventional problems, but also be contributed for the upgrade of Micro Electro-Mechanical Systems and chemical-biological technique.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The construction, devices, characteristics and the best embodiment of this invention are described with relative figures as follows.

Figure 1:
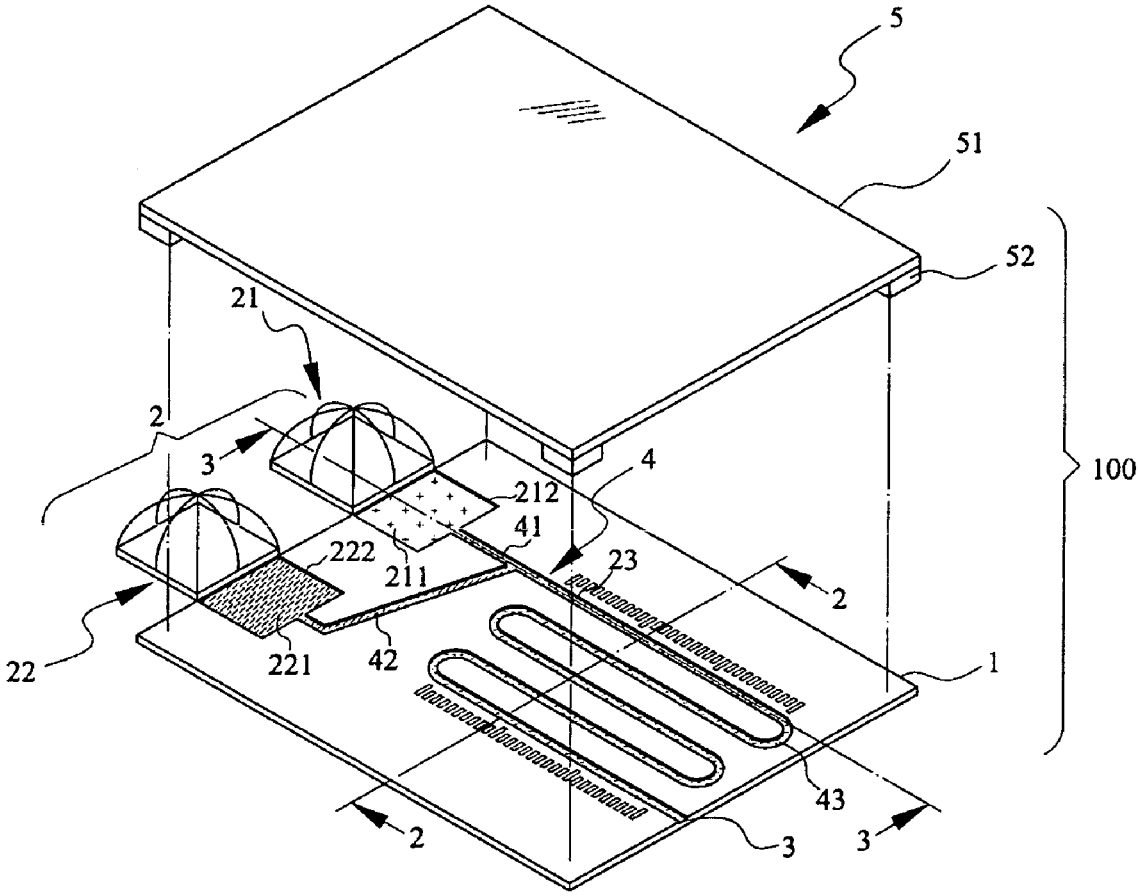
FIG. 1 is a partially exploded perspective view of a liquid transportation device in accordance with a first embodiment of the present invention.

Please refer to FIG. 1, which presents a partially exploded perspective view of a liquid transportation device in accordance with a first embodiment of the present invention. A liquid transportation device 100 is used for liquid transportation and comprises a working board 1, a liquid supply source 2, a liquid exit 3, a liquid channel 4 and a covering mechanism 5. The liquid supply source 2 includes a first liquid source 21 and a second liquid source 22. The first liquid source 21 includes a first working liquid 211 and a first liquid storage mechanism 212. The second liquid source 22 includes a second working liquid 221 and a second liquid storage mechanism 222. The liquid channel 4 includes a first branch channel 41, a second branch channel 42 and a confluent channel 43. The first working liquid 211 is transported in the first branch channel 41, and the second working liquid 221 is transported in the second branch channel 42. The covering mechanism includes a covering board 51 and a number of supporting blocks 52. As shown in FIG. 1, when the when the first working liquid 211 merges with the second working liquid 221 in a confluent place of the first branch channel 41 and the second branch channel 42, a mixing working liquid 23 is generated and transported in the confluent channel 43.

In the liquid transportation device 100, the a top surface of the working board 1 is a substantially flat working platform for liquid transportation, wherein the top surface of the working board 1 is composed of a material substantially phobic to the first working liquid 211 and the second working liquid 221. The first liquid source 21 and the second liquid source 22 are arranged on one end of the top surface of the working board 1. The first working liquid 211 and the second working liquid 221 are respectively arranged in the first liquid storage mechanism 212 and the second liquid storage mechanism 222. The surface of the first liquid storage mechanism 212 is composed of a material substantially tending to the first working liquid 211, and the surface of the second liquid storage mechanism 222 is composed of a material substantially tending to the second working liquid 221.

The liquid exit 3 is arranged on another end of the working board 1 and served as a transportation destination of the mixing working liquid 23. The surface of the liquid exit 3 is composed of a material substantially tending to the mixing working liquid 23.

The liquid channel 4 is arranged on the top surface of the working board 1. The first branch channel 41 is connected with the first liquid storage mechanism 212 and composed of a material substantially tending to the first working liquid 211, and it is the same that the second branch channel 42 is connected with the second liquid storage mechanism 222 and composed of a material substantially tending to the second working liquid 221. One end of the confluent channel 43 is connected with the first branch channel 41 and the second branch channel 42 in the confluent place, and the other end of the confluent channel 43 is connected with the liquid exit 3.

In the covering mechanism 5, the covering board 5 is covered upon the top surface of the working board 1, fully covered the liquid channel 4, and composed of a material substantially phobic to the first working liquid 211, the second working liquid 221 and the mixing working liquid 23. The supporting blocks are arranged between the working board and the covering board for lifting the covering board in a specified distance away from the working board.

As the covering mechanism is installed on the working board 1, the first working liquid 211 and the second working liquid 221 respectively stored in the first liquid source 21 and the second liquid source 22 are sufficient, the first working liquid 211 and the second working liquid 221 will be transported in the first branch channel 41 and the second branch channel 42, merging with each other to generate a mixing working liquid 23 within the confluent channel 43, and transported to the liquid exit 3.

Figure 2:
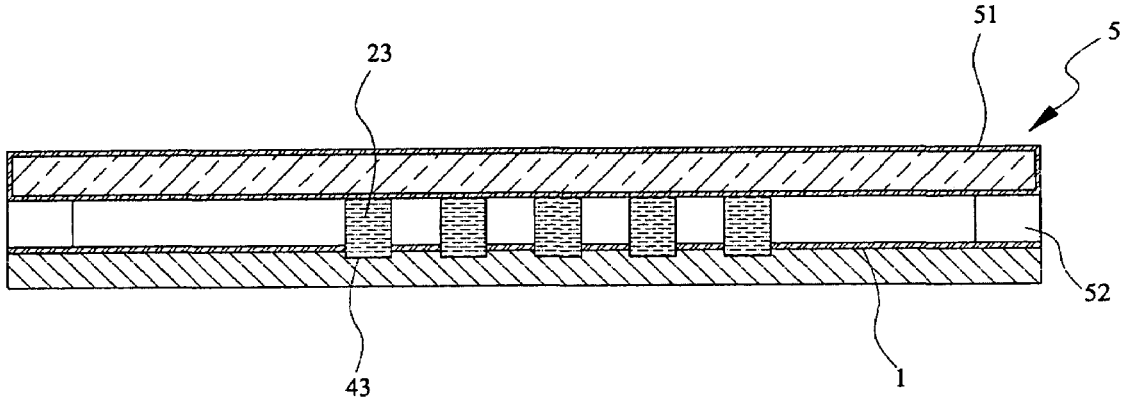
FIG. 2 is a sectional view of the liquid transportation device in accordance with the first embodiment of the present invention after covering the cover mechanism on the working base.

Please refer to FIG. 2, which presents a sectional view of the liquid transportation device in accordance with the first embodiment of the present invention after covering the cover mechanism on the working base. The confluent channel 43 is composed of a material tending to the mixing working liquid 23, and the top surface of the working board 1 is composed of a material phobic to the mixing working liquid 23. The covering board 51 keeps a specified distance away from the working board 1 through the supporting blocks 52, so that a working space is formed between the working board 1 and the covering board 51 and provided for working liquid transportation.

Figure 3:
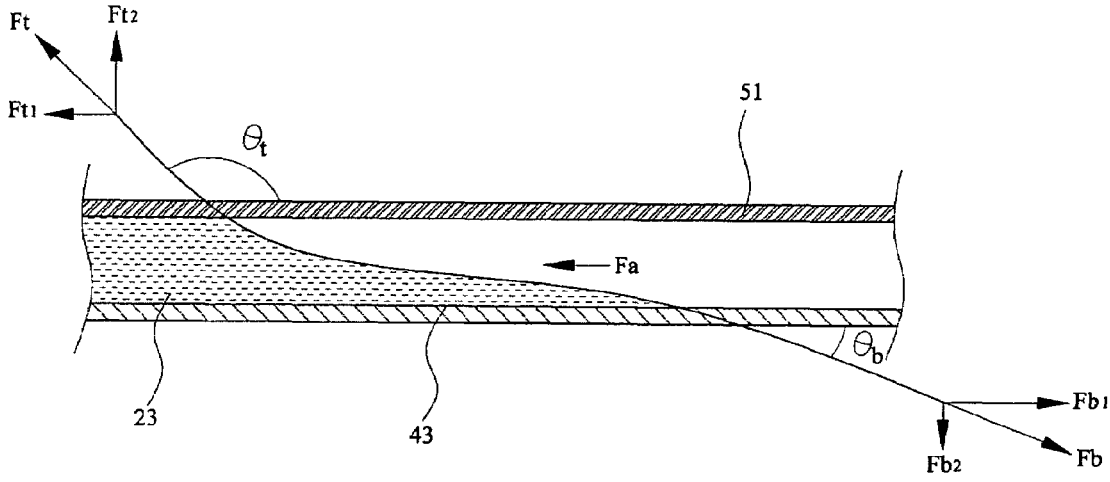
FIG. 3 is a view with respect to FIG. 1 showing the working principle of the first embodiment of the present invention.

Please refer to FIG. 3, which presents a view with respect to FIG. 1 showing the working principle of the first embodiment of the present invention. A contact angle θ b less than 90 degree and a surface tension force Fb are existed between the mixing working liquid 23 and the confluent channel 43 composed of a material tending to the mixing working liquid 23. The surface tension force Fb is composed of a horizontal component of Fb1 and a longitude component of Fb2. A contact angle θ t greater than 90 degree and a surface tension force Ft are existed between the mixing working liquid 23 and the covering board 51 composed of a material phobic to the mixing working liquid 23. The surface tension force Ft is composed of a horizontal component of Ft1 and a longitude component of Ft2. Besides, the resultant of friction forces Fa, mainly generated from air friction, is also exited. All related forces with their locations and components are shown in FIG. 3.

According to Newton's Law, when the horizontal component force Fb1 of the surface tension force Fb is greater than the resultant of the horizontal component force Ft1 of the surface tension force Ft and the resultant of friction forces Fa, the mixing working liquid 23 will be driven to flowing along the direction of the horizontal component force Fb1. i.e., the mixing working liquid 23 will be transported to liquid exit 3 along the extending direction of the confluent channel 43.

In the embodiment of the invention, both the first working liquid 211 and the second working liquid 221 can be selected from anyone of de-ionized water and blood, the top surface of the working board 1 is composed of Teflon phobic to de-ionized water and blood, the liquid channel 4 is composed of silicon dioxide tending to de-ionized water and blood, the covering is composed of glass and covered with Teflon phobic to de-ionized water and blood.

From above description with reference to FIG. 1 to FIG. 3, people skilled in this art can easily realize that the working board 1, the liquid supply source 2, the liquid exit 3, the liquid channel 4 and the covering mechanism 5 are not limited in the quantity of one piece of two pieces. The quantity of all related elements can be adjusted or designed according to the characteristics and the requirements of liquid flowing. Meanwhile, all kinds of the working boards, liquid channels and covering mechanisms complying with the relation of "The horizontal component force Fb1 of the surface tension force Fb is greater than the resultant of the horizontal component force Ft1 of the surface tension force Ft and the resultant of friction forces Fa" also can be used in the liquid transportation device as disclosed in the invention. Furthermore, between the working board 1 and the covering mechanism 5, it is unnecessary to arrange any separating or liquid guiding elements in the neighborhood of the liquid channel 4.

Figure 4:
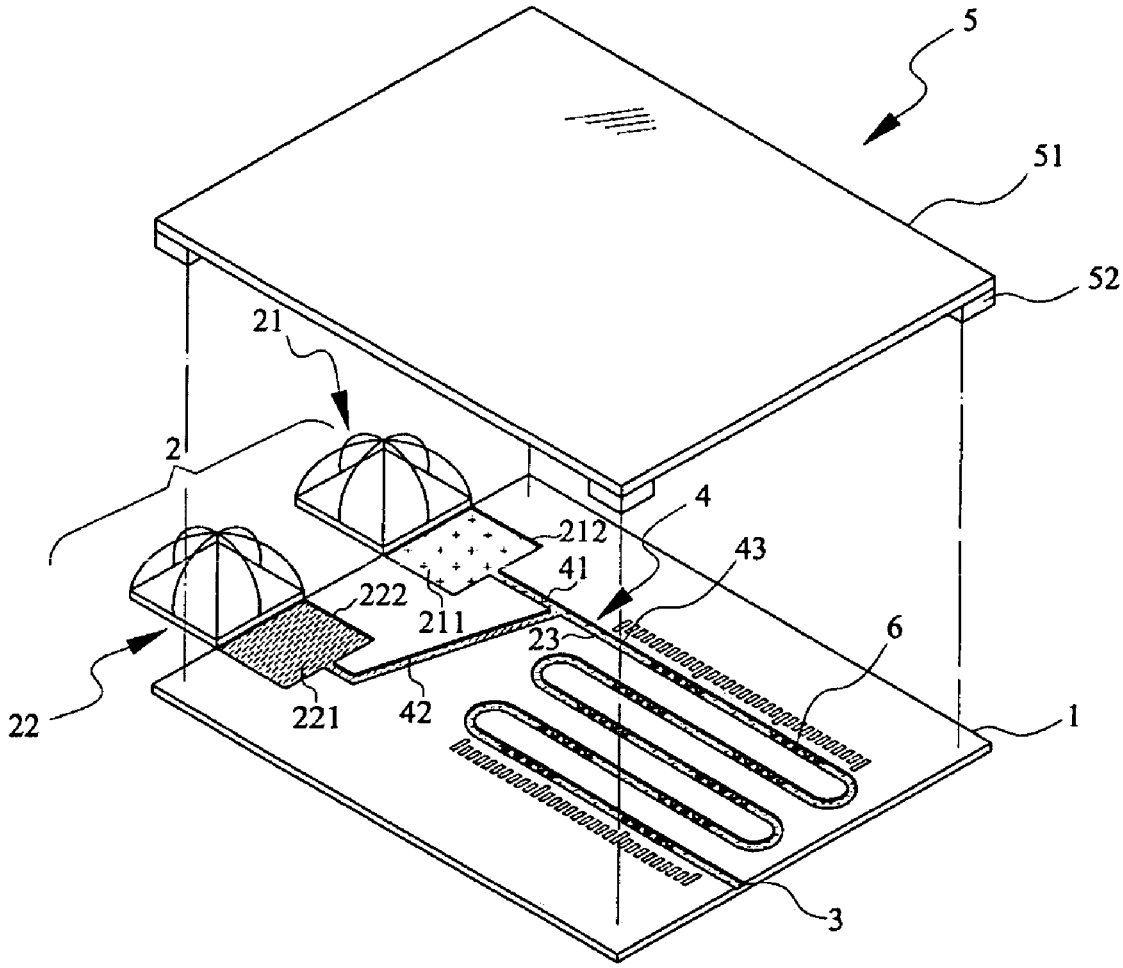
FIG. 4 is a partially exploded perspective view of a liquid transportation device in accordance with a second embodiment of the present invention showing a kind of reactant is arranged in a number of specified locations of the liquid channel.

Please refer to FIG. 4, which presents a partially exploded perspective view of a liquid transportation device in accordance with a second embodiment of the present invention showing a kind of reactant is arranged in a number of specified locations of the liquid channel. The major difference between the second embodiment and the first embodiment of the present invention is at least one reactant 6 is arranged in at least one specified location of the confluent channel 43 of the liquid channel 4, and the reactant 6 can do specified physical reactions or chemical reactions with the mixing working liquid 23. Thus, the testing engineers or operators can get chemical and biological specimens via the device. When the mixing is chemical and biological specimens, such as tested blood, and the reactant is quarantine reagent, the operator can directly get the test result via the device. People skilled in this art can easily realize that the reactant 6 can be provided in liquid-state fluid or minute solid-state particles.

Figure 5:
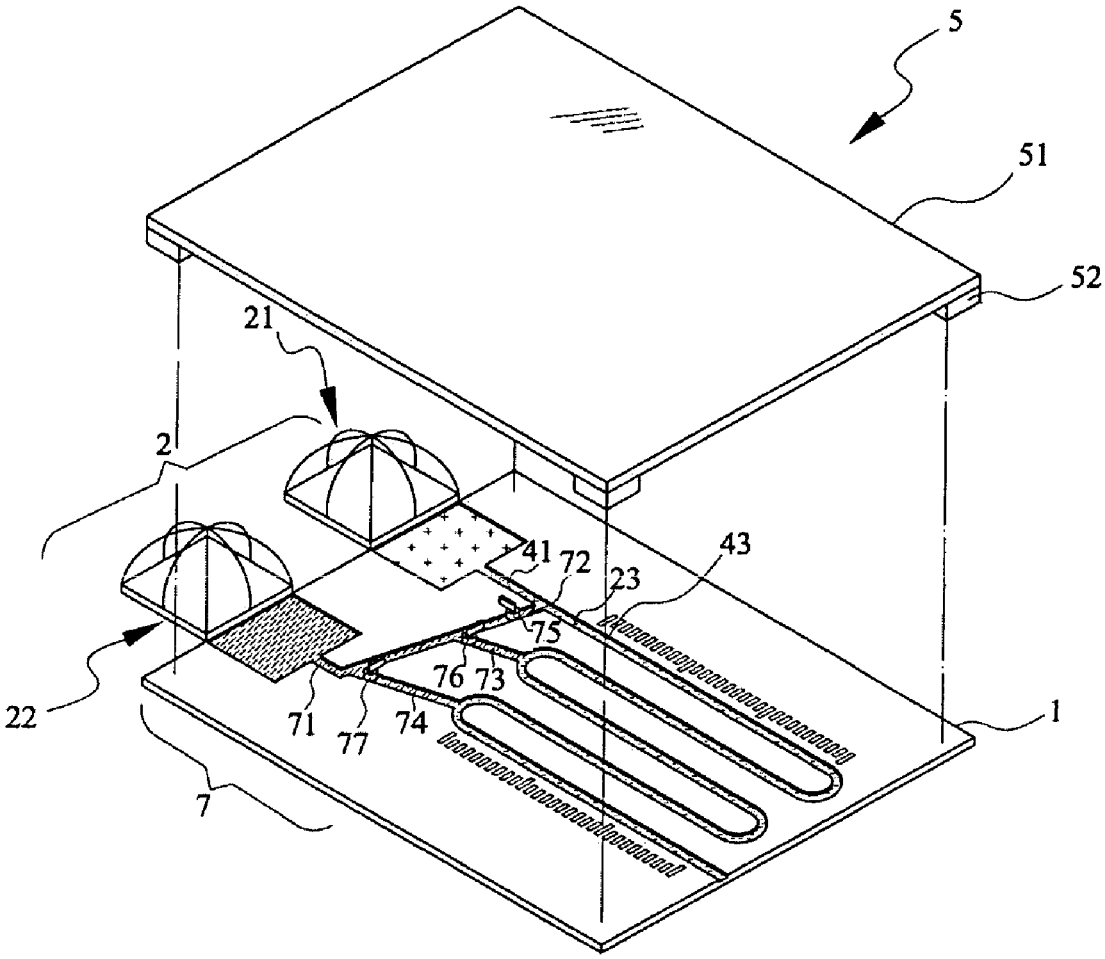
FIG. 5 is a partially exploded perspective view of a liquid transportation device in accordance with a third embodiment of the present invention showing a set of liquid control runner and liquid control gate for controlling liquid transportation rate are arranged on the working board.

Please refer to FIG. 5, which presents a partially exploded perspective view of a liquid transportation device in accordance with a third embodiment of the present invention showing a set of liquid control runner and liquid control gate for controlling liquid transportation rate are arranged on the working board. The major difference between the third embodiment and the first embodiment of the present invention is the second branch channel 42 is replaces by a liquid control mechanism 7. The liquid control mechanism 7 comprises a main runner 71, a first liquid control runner 72, a second liquid control runner 73, a third liquid control runner 74, a first liquid control gate 75, a second liquid control gate 76 and a third liquid control gate 77. The first liquid control runner 72, the second liquid control runner 73 and the third liquid control runner 74 are connected with the headstream part, the midstream part and the downstream part of confluent channel 43 respectively. The first liquid control gate 75, the second liquid control gate 76 and the third liquid control gate 77 are used to control the opening or closing of the first liquid control runner 72, the second liquid control runner 73 and the third liquid control runner 74. All surfaces of the main runner 71, the first liquid control runner 72, the second liquid control runner 73, the third liquid control runner 74, the first liquid control gate 75, the second liquid control gate 76 and the third liquid control gate 77 are composed of a material substantially phobic to the second working liquid 221.

People skilled in this art can easily realize that the third embodiment will be contributed in the adjustment and control for the mixing time of the first working liquid 211 and the second working liquid 221. Besides, the quantity of the liquid control runner and the liquid control gate can be adjusted, and the arrangement of the liquid control runner and the liquid control gate also can be designed according to the actual requirements.

Figure 6:
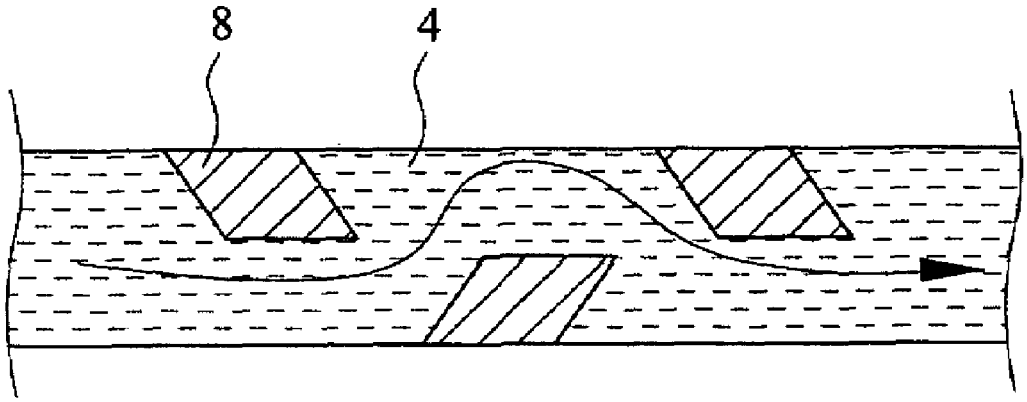
FIG. 6 is a partial top view of a liquid transportation device in accordance with a fourth embodiment of the present invention showing a number of throttling wedges are arranged on the liquid channel.

Please refer to FIG. 6, which presents a partial top view of a liquid transportation device in accordance with a fourth embodiment of the present invention showing a number of throttling wedges are arranged on the liquid channel. The major difference between the fourth embodiment and the first embodiment of the present invention is a number of throttling wedges 8 are arranged in the liquid channel 4, including the first branch channel 41, the second branch channel 42 and the confluent channel 43. The surfaces of the throttling wedges are composed of a material tending the first working liquid 211, the second working liquid 221 and the mixing working liquid 23.

People skilled in this art can easily realize that the fourth embodiment will be contributed in the flow rate adjustment and control of the first working liquid 211, the second working liquid 221 and the mixing working liquid 23. By the way, the throttling wedges 8 and are not limited in the limitation that they need to be arranged in all of the first branch channel 41, the second branch channel 42 and the confluent channel 43, so that all of them can be arranged according to the actual requirements.

Figure 7:
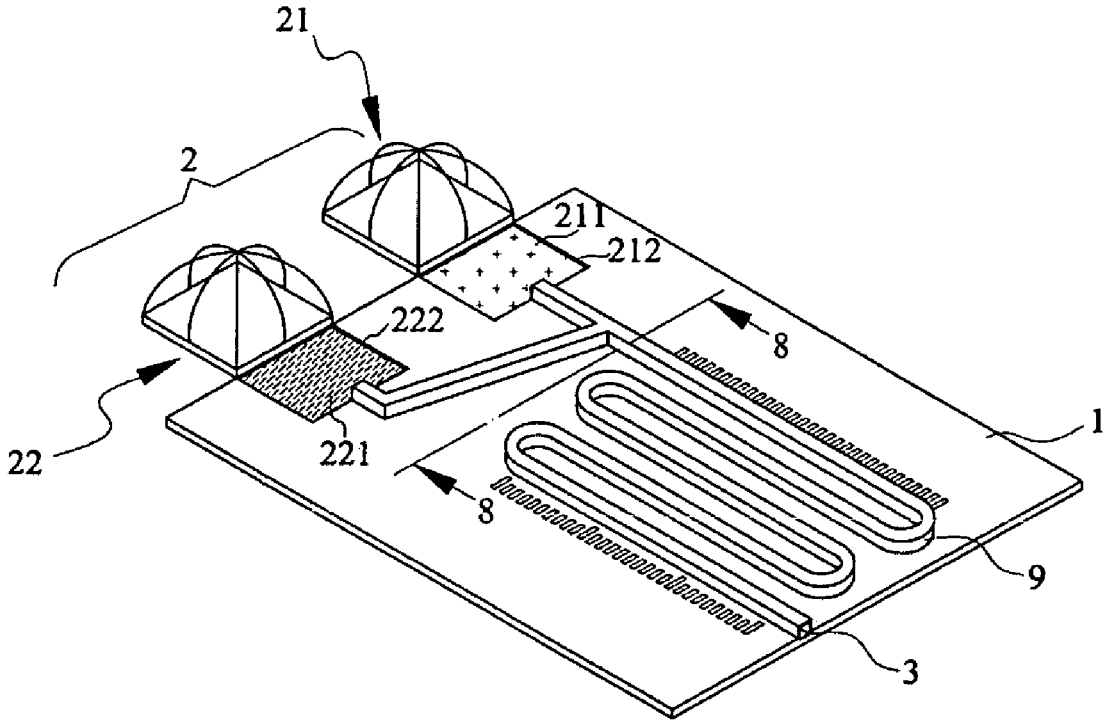
FIG. 7 is a perspective view of a liquid transportation device in accordance with a fifth embodiment of the present invention showing that a n-sectional covering board is arranged along the liquid channel.

Please refer to FIG. 7, which presents a perspective view of a liquid transportation device in accordance with a fifth embodiment of the present invention showing that a n-sectional covering board is arranged along the liquid channel. The major difference between the fifth embodiment and the first embodiment of the present invention is the covering board 51 and the supporting blocks 52 are formed in an integral part with a n-sectional, hereof being defined as a n-sectional covering board 9, and arranged and covered along the liquid channel.

Figure 8:
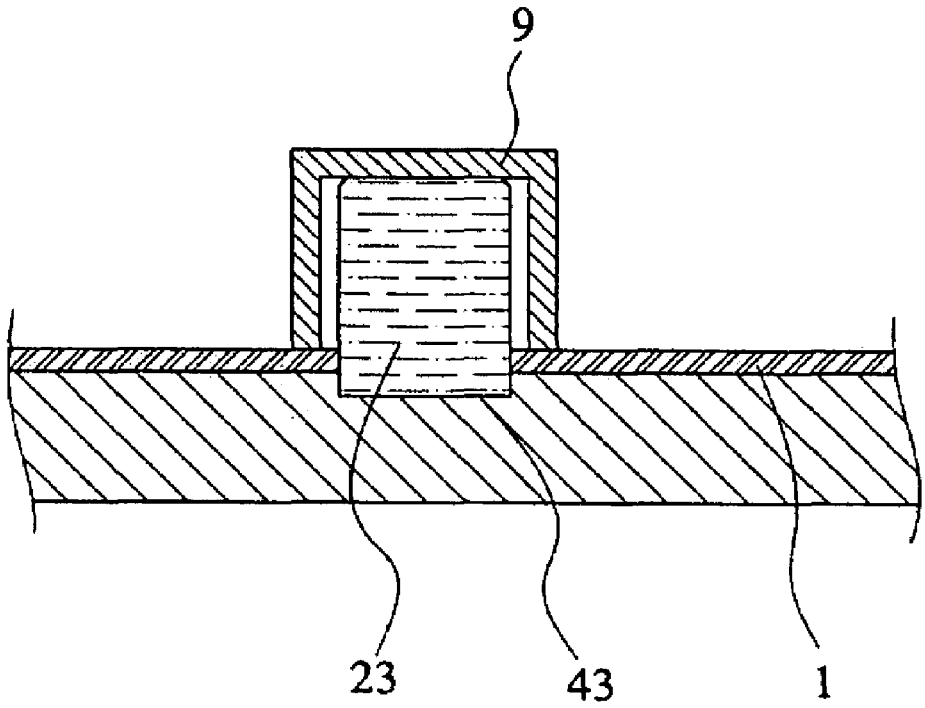
FIG. 8 is a partial sectional view of a liquid transportation device in accordance with the fifth embodiment of the present invention.

Please refer to FIG. 8, which presents a partial sectional view of a liquid transportation device in accordance with the fifth embodiment of the present invention. A hermetical space for liquid transportation is constructed by the a n-sectional covering board 9 and the liquid channel 4. When the first working liquid 211, the second working liquid 221 or the mixing working liquid 23 flows within the hermetical space, a proper clearance is necessary to be kept between sidewalls of the liquid channel 4 and anyone of the first working liquid 211, the second working liquid 221 and the mixing working liquid 23.

People skilled in this art can easily realize that the fifth embodiment will be contributed in keeping the first working liquid 211, the second working liquid 221 and the mixing working liquid 23 flowing along the liquid channel free from any interference of unpredictable external forces.

To make a summary, the liquid transportation device in accordance with the present invention not only has solved the existed problems effectively but also brings novel, practicable and progressive value meeting the essence of patent to be applied for.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A liquid transportation device for transporting at least one working liquid comprising:

at least one liquid storage mechanism for storing and collecting the working liquid thereon;

a working board composed of a material substantially phobic to the working liquid, having a first end communicated with the liquid storage mechanism;

at least a liquid exit formed on a second end of the working board;

at least one liquid channel composed of a material substantially tending to the working liquid and formed on a top surface of the working board for connecting the liquid storage mechanism to the liquid exit;

at least one covering board covered upon the top surface of the working board, covering the liquid channel, and composed of a material substantially phobic to the working liquid; and a plurality of supporting blocks arranged between the working board and the covering board for lifting the covering board in a specified distance away from the working board;

wherein the liquid is guided by a deviation of surface tension existing between the liquid channel to the working liquid, and the covering board to the working liquid.

2. The liquid transportation device as claimed in claim 1, wherein the working liquid is de-ionized water, the working board is composed of Teflon phobic to de-ionized water, the liquid channel is composed of silicon dioxide tending to de-ionized water, the covering board is composed of glass with a Teflon covered surface phobic to de-ionized water.

3. The liquid transportation device as claimed in claim 1, wherein the liquid is blood, the working board is composed of Teflon phobic to blood, the liquid channel is composed of silicon dioxide tending to blood, the covering board is composed of glass with a Teflon covered surface phobic to blood.

4. The liquid transportation device as claimed in claim 1, wherein at least one reactant is arranged in at least one specified location of the liquid channel.

5. The liquid transportation device as claimed in claim 4, wherein the reactant is liquid-state fluid.

6. The liquid transportation device as claimed in claim 4, wherein the reactant is minute solid-state particles.

7. The liquid transportation device as claimed in claim 1, wherein at least one liquid control runner and liquid control gate for controlling liquid transportation rate are arranged on the working board between the liquid storage mechanism and the liquid channel.

8. The liquid transportation device as claimed in claim 7, wherein the liquid control runner is composed of a material substantially phobic to the liquid, and the liquid control gate is composed of a material substantially tending to the liquid.

9. The liquid transportation device as claimed in claim 1, wherein a number of throttling wedges are arranged on the liquid channel composed of a material tending to the liquid.

10. The liquid transportation device as claimed in claim 1, wherein the covering board and the supporting blocks are formed in an integral part with a n-sectional, and arranged and covered along the liquid channel to provide a hermetical space for liquid transportation.

11. The liquid transportation device as claimed in claim 10, wherein the n-sectional covering board is composed of a material substantially phobic to the liquid.

* * * * *